United States Patent [19]

Flittie

[11] 4,186,389

[45] Jan. 29, 1980

[54] SLEEPER'S SMOKE-ALARM CLOCK

[76] Inventor: Clifford G. Flittie, 33 Stonehouse Rd., Scarsdale, N.Y. 10583

[21] Appl. No.: 876,332

[22] Filed: Feb. 9, 1978

[51] Int. Cl.[2] ..... G04B 47/00; G08B 17/10

[52] U.S. Cl. ..... 340/628; 58/152 B; 250/573; 340/630

[58] Field of Search ..... 340/630, 628; 58/19 R, 58/19 A, 19 B, 19 C, 152 B, 152 R; 250/573, 574

[56] References Cited

U.S. PATENT DOCUMENTS

| | | | |
|---|---|---|---|
| 1,521,600 | 1/1925 | Crowe | 58/19 A |
| 3,555,532 | 1/1971 | White et al. | 340/630 |
| 3,824,789 | 7/1974 | Müller et al. | 58/19 R |
| 3,846,773 | 11/1974 | Lintelmann et al. | 340/630 X |

FOREIGN PATENT DOCUMENTS

| | | | |
|---|---|---|---|
| 78146 | 2/1951 | Norway | 58/19 B |

*Primary Examiner*—John W. Caldwell, Sr.
*Assistant Examiner*—Daniel Myer
*Attorney, Agent, or Firm*—Kenyon & Kenyon

[57] ABSTRACT

An alarm device functioning both as a time alarm and a smoke and fire alarm, which includes an electric clock with an alarm-setting device, an electrically-activated alarm, cooperating contacts on the clock and alarm, a switch coupling the contacts to the alarm to permit switching the time alarm on and off, an electronic smoke detector and an amplifier to amplify the output of the smoke detector as a second input to the alarm.

10 Claims, 2 Drawing Figures

SLEEPER'S SMOKE-ALARM CLOCK

BACKGROUND OF THE INVENTION

This invention relates to alarm devices in general, and more particularly to an improved alarm device which serves the dual function of a time alarm and a smoke alarm.

For the past few years, there have appeared on the market numerous smoke alarm devices. These devices can be classified according to the type of power they use and according to the type detector which is used. Basically such devices are available either as house current operated devices or battery operated devices. The advantage of devices operating on house current is that one does not have to be concerned about batteries going dead. The advantage of the battery operated devices, of course, is that they continue to operate even when there is a loss of house current due to a fire or for some other reason. The detectors used on these alarms are normally either a photoelectric type detector which includes a light source and a photoreceptor or an ionization detector. As used herein, the term "smoke detector" is generic to those two types of detectors.

Although various possibilities exist, one of the most efficient type photoelectric devices comprises a light emitting diode as the light source and a photodiode as the photo-receptor. The use of a light emitting diode makes a battery operated photoelectric detector much more feasible. In photoelectric detectors the two devices are not lined up and the receptor normally does not intercept the light. Smoke particles entering the chamber scatter the light causing some of it to be reflected onto the receptor. When the receptor receives sufficient light an alarm is sounded.

Ionization detectors, on the other hand, work on the principal of bombarding the air in a small chamber with radioactive particles. The radioactive particles ionize the air so that it will carry a weak electric current. When the particles released due to combustion enter the chamber they interfere with the current flow and, at a predetermined level, the decrease in current flow causes an alarm to trigger. Tests have shown that ionization detectors respond more quickly to flaming fires and photoelectric units respond much faster to smoldering fires. There has been much discussion over which of these are the best and what the detection limits should be.

These smoke alarms sound quite loudly, since they are normally placed in a central location in a home and must wake up the whole family who may be in different bedrooms scattered about the house. Normally the best place to locate such detectors is in an upstairs hall where heat and smoke would reach the detector from anywhere in the house. Thus, with presently available devices it is possible to protect oneself from most home fires. However, there are other instances where detection is not so available.

Suppose a detector is located in the hall outside the bedrooms and the family goes to sleep with their bedroom doors closed. If a fire starts in one of the bedrooms it is quite possible that the alarm will not sound soon enough to allow the occupants of that bedroom to escape safely since the smoke must essentially fill the room and then begin to seep out before it reaches the detector in the hall. One solution to this would be, of course, to supply detectors in each room. However, these detectors are fairly bulky and expensive. A traveller faces a more serious problem. Although most hotels and motels are equipped with fire protection systems, typically sprinkler systems, it is well known that many people have been killed or injured in hotel fires. One reason for this may be that the sprinkler systems, which normally respond to heat, in the case of a smoldering fire, may not respond until it is too late. Furthermore, in various parts of the world standards are not always as high as they are in the more developed countries and some hotels and motels may be without fire protection.

Of course, the solution to this problem might be carrying a smoke detector along when travelling. Although, this would work, one wonders what would happen if the smoke detector was accidentally triggered due to smoke from a cigarette, for example. The alarm has a particularly loud and shrill sound which would undoubtedly disturb all of the guests in the surrounding rooms and which could eventually lead to the banning of such detectors in hotels.

It thus becomes apparent that there is a need for additional protection against smoke and fire, particularly for the traveller.

SUMMARY OF THE INVENTION

The present invention provides a solution to this problem. As is well known, prudent travellers carry with them a portable alarm clock (one cannot always rely on the hotel remembering a wakeup call). Thus, in order to provide the traveller, in particular, with both an alarm clock and a smoke alarm, the present invention incorporates both into a single device. Although particularly directed to travellers, the invention is also applicable to bedroom alarm clocks giving added protection against fires which may start in the bedroom.

In general terms, the present invention includes a smoke detector which can be of the ionization or photoelectric type. Since it is thought that in the situation where the present invention is applicable, smoke is more dangerous, i.e., other protective systems would probably quickly detect a flaming fire, it is preferred that the detector be a photoelectric smoke detector. The smoke detector is built into an alarm clock. The only requirements placed on the alarm clock are that it must have a time output and an alarm setting output and means for comparing those two outputs. The device also includes an alarm which receives inputs from the alarm clock comparison means and, after appropriate amplification, from the smoke detector. Thus, in a typical embodiment the alarm clock is an electric clock with an electric clock motor and which includes contacts coupled respectively to its minute hand and alarm setting hand which close when the two match, a photodetector and associated amplifying means and an alarm coupled to both the outputs of the contacts associated with the hands and the amplifying means of the photodetector. In order to turn the alarm on and off, a switch is coupled between these outputs and the alarm. The amplified photodetector output couples into the alarm behind the switch so that it is always active.

In the preferred embodiment, both the clock and photodetector system are battery operated. Furthermore, the battery is of a rechargeable nature and the system includes a transformer and rectifier for recharging the battery and supplying the circuit when AC current is available. However, a completely AC system or completely battery operated system is also possible.

The device has numerous applications, one being a combination alarm clock and smoke detector for use by travellers to alert them to hotel fires (which so often are disasterous), use in household bedrooms or other household locations and use by individuals residing in homes for the elderly or nursing homes, both of which have a tragic record of loss of life due to night-time fires.

DETAILED DESCRIPTION OF THE INVENTION

Figure 1:
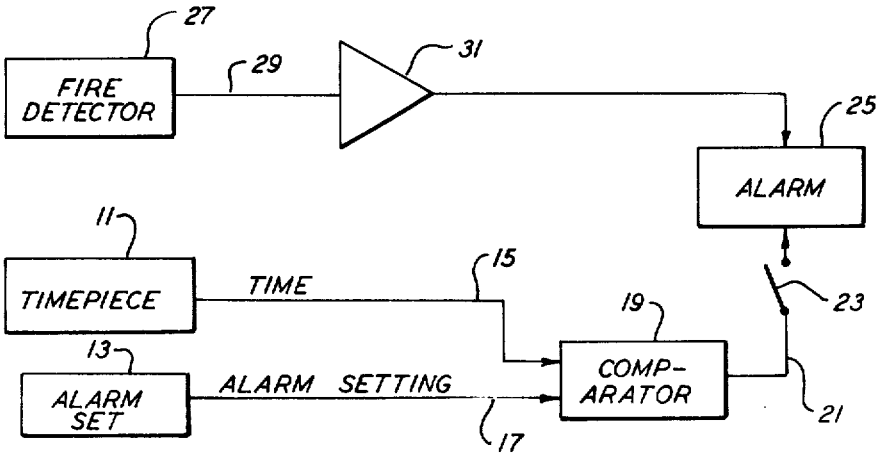
FIG. 1 is an overall block diagram of the alarm system of the present invention.

FIG. 1 illustrates in block diagram form the basic elements of the present invention. These include a timepiece 11 which provides an output representing the time of day. This output may be in the form of the hands of a clock, a digital read-out or simply an analog or digital signal representing time. Also provided are alarm set means 13 for setting a time at which an alarm is to go off. Again, this may be a hand on the clock, a numerical read-out setting or the like. The two outputs, time on line 15 and the alarm setting on line 17 are inputs to a comparator 19. The comparator may be of a mechanical nature, e.g., a pair of contacts in a clock with hands, or may be electronic, i.e., an analog or digital comparator. When the time on line 15 matches the alarm setting on line 17 the comparator provides an output on line 21 which is coupled through a alarm. Also included is a detector 27 for detecting smoke. This detector may be an ionization detector or photoelectric smoke detector. The detector output on line 29 is amplified in an amplifier 31 and provided as a second input to the alarm. This input is not coupled through the switch 23 and thus whether the time alarm is activated or not, if the detector 27 provides an output on line 29 indicating the presence of smoke or other combustion products, the clock alarm 25 will sound.

Figure 2:
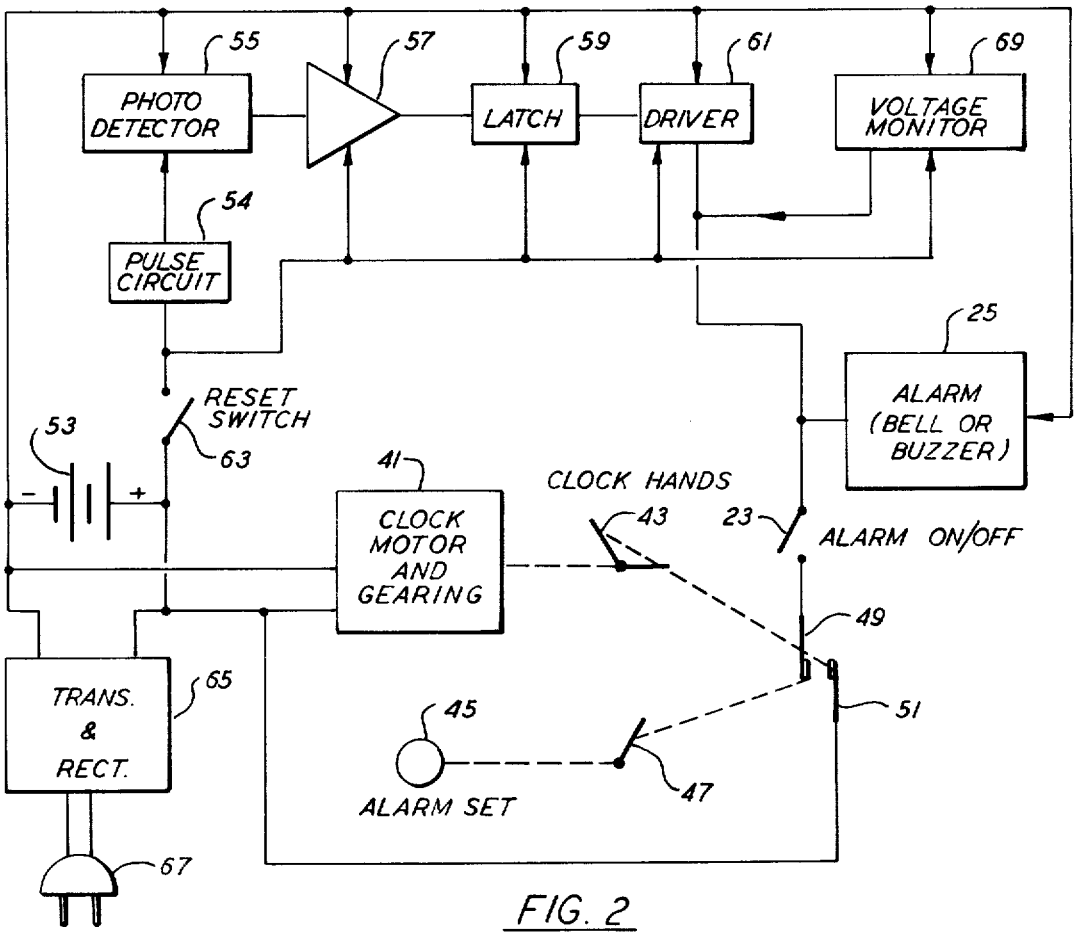
FIG. 2 is a more detailed block diagram of a specific embodiment of the present invention.

FIG. 2 illustrates a more detailed block diagram of a specific embodiment of the present invention which is particularly adaptable as a travel alarm which gives the traveller both the function of a time alarm and an alarm in the case of a fire in his hotel.

In this embodiment, the time piece comprises an electric clock motor 41 which is battery operated. Such clock motors are well known in the art and operate on an oscillating principle. The motor includes the necessary gearing to drive clock hands 43. Also included with the clock are means 45 for setting an alarm. The alarm setting means are mechanically coupled to a hand 47. Mechanically coupled to the hand 43 is a contact 49. A second contact 51 is coupled to the hand 47. When the hands 43 and 47 come into registration, the contacts 49 and 51 close. Such arrangements in clocks are well known and described, for example, in U.S. Pat. No. 1,521,600. The clock motor 41 is supplied with power from a battery 53, prefeably a rechargeable battery. The battery is supplied from a transformer and rectifier unit 65 of conventional design which is equipped with a plug 67 to plug in a wall outlet. The positive side of the battery is also coupled to the contact 51. The contact 49 is coupled through the switch 23 to the alarm 25. The negative side of the battery 53 is also coupled into the alarm 25 to complete the circuit. When the contacts 49 and 51 come into registration, indicating that the time of day is the same as the time set on the hands 47, if the switch 23 is closed, the clock alarm 25 will sound. Opening the switch 23 disables the time alarm.

The second input to the alarm 25 originates with a photo detector 55. It is thought that for this specific application, e.g., a travelling alarm, a photodetector which will detect smoke is superior to an ionization detector. The photodetector is supplied with power from the battery 53. In order to save power, a pulse circuit 57 may be interposed between the battery and the photodetector so as to only turn it on at predetermined intervals to save on battery life. However, since in most instances, a source of power will be available, the pulse circuit is not nearly as important as it is in battery operated photodetector fire alarms where it is desirable to have long battery life.

The output of photodetector 55 is coupled through an amplifier 57, the output of which is an input to a latch 59. The latch 59 insures that once the photodetector detects smoke, even if the smoke level drops below the response threshold, an output for driving the clock alarm will still be available. The output of latch 59 is coupled through an appropriate driver 61 to the clock alarm 25. Each of the elements is supplied with power from the battery 53 through a switch 63 which is indicated as being a reset switch. Once the latch 59 is set, only by opening the reset switch is it possible to stop the clock alarm. A specific circuit which has the characteristics of the smoke alarm detector shown in FIG. 2, is disclosed in detail in U.S. Pat. No. 3,846,773.

The clock 41 is supplied from the battery without being coupled through the switch 63 so that it operates at all times. Similarly, even if the switch 63 is open the clock alarm 25 will operate since the negative side of the battery is not interrupted. Also shown as an optional element is a voltage monitor 69 coupled across the battery. Such voltage monitors are often used with fire alarms to notify the user when his battery is running down. Again, such is not nearly as important in a device such as that of the present invention since it will normally be plugged in to an AC outlet. For example, if there was a battery problem, it would become apparent from the improper operation of the clock. However, if desired such a voltage monitor which activates the alarm 25 can be provided. It should also be noted that use of the rechargeable battery along with a rectifier unit avoids the problems associated with loss of house current in solely AC operated devices and the problem of batteries going dead in solely battery operated devices.

What is claimed is:

1. An alarm device capable of providing both a time alarm and a fire alarm comprising:

(a) a timepiece providing an output representing time of day;

(b) means for setting an alarm time and providing an output representative thereof;

(c) means to compare said time of day output with said alarm time output and to provide an output when the two coincide;

(d) an electrically operated alarm;

(e) a switch coupling the output of said means to compare to said alarm;

(f) an electronic smoke detector;

(g) means to amplify the output of said smoke detector; and (h) means coupling the output of said means to amplify to said alarm.

2. The apparatus of claim 1 wherein said timepiece comprises a clock having time hands and a dial, said output representing time of day being said time hands and their position with respect to said dial, said means for setting an alarm time and providing an output indicative thereof being an alarm hand, said means for comparison being cooperating contacts coupled to said time hands and said alarm hand and providing a switch closure when said hands are in alignment.

3. A battery operated alarm device capable of giving a time of day and a fire alarm comprising:

(a) a battery;

(b) an electric clock including a clock motor and gearing with clock hands attached thereto receiving input power from said battery;

(c) means, including an alarm hand for setting an alarm time;

(d) contacts coupled to said clock hands and said alarm hand respectively and adapted to close when said hands are in alignment;

(e) an alarm;

(f) a switch coupling said contacts to said alarm, said battery coupled across said alarm through said contacts and said switch;

(g) means for detecting the presence of smoke and providing an output indicative thereof;

(h) means to amplify the output of said means for detecting and provide an amplified output;

(i) latching means for latching in response to an output from said means for amplifying; and (j) means for coupling the output of said latching means to said alarm.

4. Apparatus according to claim 3 wherein said means for coupling include a driver between said latching means and said alarm.

5. Apparatus according to claim 4 wherein said smoke detector comprises a photodetector.

6. Apparatus according to claim 4 and further including a pulse circuit interposed between said battery and said photodetector for pulsing said photodetector to reduce power consumption.

7. Apparatus according to claim 3 wherein said battery is a rechargeable battery and further including a transformer and rectifier unit for recharging said battery and for supplying power to said apparatus.

8. Apparatus according to claim 3 wherein said means for detecting means the amplify and latching means are powered by said battery and further including a reset switch coupling said battery to at least said latch whereby opening said switch will permit resetting said latch.

9. Apparatus according to claim 3 and further including a voltage monitor across said battery providing an output to said alarm when said battery voltage drops below a predetermined limit.

10. Apparatus according to claim 3 wherein said smoke detector comprises a photodetector.

* * * * *